US005083602A

United States Patent [19]

Skibo

[11] Patent Number: 5,083,602

[45] Date of Patent: Jan. 28, 1992

[54] STEPPED ALLOYING IN THE PRODUCTION OF CAST COMPOSITE MATERIALS (ALUMINUM MATRIX AND SILICON ADDITIONS)

[75] Inventor: Michael D. Skibo, Leucadia, Calif.

[73] Assignee: Alcan Aluminum Corporation, San Diego, Calif.

[21] Appl. No.: 558,630

[22] Filed: Jul. 26, 1990

[51] Int. Cl.[5] ..... B22D 19/14

[52] U.S. Cl. ..... 164/97; 164/101; 420/549

[58] Field of Search ..... 164/97, 10 D, 101; 420/548, 549

[56] References Cited

U.S. PATENT DOCUMENTS

| | | | |
|---|---|---|---|
| 2,793,949 | 5/1957 | Imich | 164/97 |
| 4,185,999 | 1/1980 | Seese | 420/549 |
| 4,450,207 | 5/1984 | Donomoto | 428/608 |
| 4,481,031 | 11/1984 | Eriksson | 420/548 |
| 4,720,434 | 1/1988 | Kubo | 420/548 |
| 4,759,995 | 7/1988 | Skibo | 420/532 |
| 4,902,475 | 2/1990 | Apelain | 420/549 |

FOREIGN PATENT DOCUMENTS

| | | | |
|---|---|---|---|
| 305311 | 2/1929 | United Kingdom | 420/549 |
| 374370 | 6/1932 | United Kingdom | 420/549 |
| 629048 | 9/1949 | United Kingdom | 420/549 |

*Primary Examiner*—Richard K. Seidel
*Assistant Examiner*—Rex E. Pelto
*Attorney, Agent, or Firm*—Gregory Garmong

[57] ABSTRACT

A cast composite material is made from particles and a matrix alloy of preselected composition that is difficult to wet to the particles. A wetting alloy having a composition that readily wets the particles is first mixed with the particles under conditions that wet the wetting alloy to the particles. The wetting alloy is selected so that is has no alloying elements in excess of that in the preselected matrix alloy, and preferably with wettability inhibiting elements reduced. After wetting and mixing have been achieved, the remaining alloying ingredients are added to the melt to adjust the matrix to the desired composition. The approach is applicable to cast composite materials containing both reactive and nonreactive particles. (aluminum matrix with silicon additions).

5 Claims, 1 Drawing Sheet

STEPPED ALLOYING IN THE PRODUCTION OF CAST COMPOSITE MATERIALS (ALUMINUM MATRIX AND SILICON ADDITIONS)

BACKGROUND OF THE INVENTION

This invention relates to cast composite materials, and, more particularly, to the preparation of such composite materials having matrix alloys that do not readily wet the reinforcement particles.

Cast composite materials are conventionally formed by melting a matrix alloy in a reactor and then adding particles. The mixture is vigorously mixed to encourage wetting of the matrix alloy to the particles, and after a suitable mixing time the mixture is cast into molds or forms. The mixing is conducted while minimizing the introduction of gas into the mixture. The cast composite materials have fully wetted particles, few voids, and a generally uniformly mixed structure. Complete wetting is necessary to realize the full composite strength and other mechanical properties.

Such cast composite materials are much less expensive to prepare than other types of metal-matrix composite materials such as those produced by powder metallurgical technology. Composite materials produced by this approach, as described in U.S. Pat. Nos. 4,759,995 and 4,786,467, have enjoyed commercial success in only a few years after their first introduction.

As the cast composite materials have entered commercial production, customers have sometimes requested particle/matrix alloy combinations wherein the matrix does not readily wet the particles. In other instances, new metallic alloys have been identified that produce unexpectedly superior performance when used as the matrix phase of the composite materials, except for the problem that the composite materials are difficult to produce commercially due to the inability of the matrix alloy to wet and mix with the particles readily.

There are a number of techniques that can be applied to enhance wetting, which may work in some circumstances. The particles can be modified with special coatings, but the coating operation can significantly raise the cost of the particles and the composite material. Small amounts of reactive gases can be introduced into the mixing chamber, but the improved wetting may only be achieved at the cost of increased porosity in the cast composite material. Special reactive alloying ingredients can be added to the melt, but these are often expensive and may have adverse consequences in the production of undesired minor phases in the cast composite material. Another approach is to raise the temperature at which the mixing to achieve wetting is accomplished, but increased temperature may also result in the acceleration of the production of deleterious minor phases where such phases are thermodynamically favored but kinetically slow in forming at lower temperatures.

There therefore exists a continuing need for an improved technique for producing cast composite materials from particle/matrix alloy combinations wherein the matrix does not inherently readily wet the particle. Desirably, any such technique would not add substantially to the cost of the product or have detrimental effects. The present invention fulfills this need, and further provides related advantages.

SUMMARY OF THE INVENTION

The present invention provides a process modification that permits the production of many cast composite material particle/matrix alloy compositions that are difficult to prepare because the matrix alloy does not wet the particles. No new alloying ingredients or atmospheric additions are required, the particles need not be coated, and the temperature is not raised over that normally used. The cost of the production operation remains essentially unchanged from that of conventional procedures. In some instances the quality of the resulting composite materials is surprisingly improved over anything previously known.

In accordance with the invention, a process for preparing a cast composite material having particles embedded in an aluminum-alloy matrix of a preselected composition that does not readily wet the particles comprises the steps of providing a molten mixture of the particles and a wetting alloy having a composition that readily wets the particles and has no alloying elements present in an amount substantially in excess of the preselected matrix composition; mixing together the molten mixture under conditions such that the wetting alloy is wetted to the particles; adding additional alloying ingredients to the melt to adjust the composition of the matrix to the preselected composition and distributing the additional alloying ingredients throughout the melt; and casting the resulting melt.

The present invention rests upon the realization that some matrix alloy compositions enhance wetting of particular particle types, and other compositions impede wetting. When a difficult-to-wet combination of particle and matrix alloy composition is to be prepared, according to the present invention the matrix alloy is evaluated for the presence of either wettability enhancing elements, combinations, or amounts, or wettability inhibiting elements, combinations, or amounts.

If such enhancing or inhibiting compositions can be identified for a composite system, a wetting alloy composition is designed to take advantage of that situation. The wetting alloy must contain not more than the required amount of each element in the final matrix alloy composition, but can contain less or none. Wetting of the matrix to the particles is then achieved with the wetting alloy. After wetting is accomplished, the composition of the matrix is adjusted with further alloying additions to reach the desired final matrix composition.

The present invention provides an important advance in the art of preparation of cast composite materials. Composite materials can be prepared from materials combinations that are otherwise not commercially feasible, without adding special alloying ingredients or gases that might adversely affect the final product, without specially coating the particles, and without raising the temperature to unacceptably high levels. Other features and advantages of the invention will be apparent from the following more detailed description of the preferred embodiments, which illustrate, by way of example, the principles of the invention.

DETAILED DESCRIPTION OF THE PREFERRED EMBODIMENTS

Figure 1:
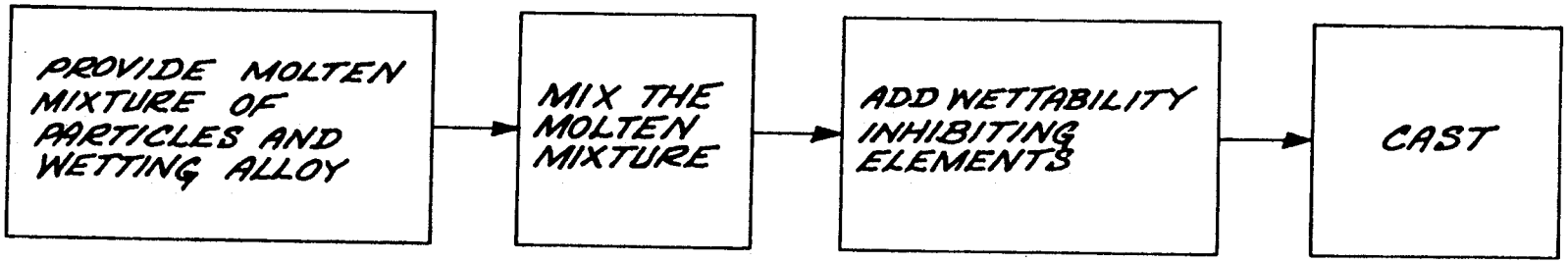
FIG. 1 is a process flow chart for the preferred approach of the invention.

In accordance with the invention, a process for preparing a cast composite material having particles embedded in a matrix of a preselected composition that wets the particles only with great difficulty comprises the steps of providing a molten mixture of the particles and a wetting alloy having a composition of the preselected matrix composition but with a deficiency in a wettability inhibiting element, the wetting alloy being readily wetted to the particles during mixing; mixing together the molten mixture to wet the wetting alloy to the particles under conditions that the particles are distributed throughout the volume of the melt and the particles and the metallic melt are sheared past each other to promote wetting of the particles by the melt, the mixing to occur while minimizing the introduction of any gas into, and while minimizing the retention of any gas within, the mixture of particles and molten metal, and at a temperature whereat the particles do not substantially chemically degrade in the molten metal in the time required to complete said step of mixing; adding the wettability inhibiting elements to the melt so that the matrix has the preselected composition; and casting the resulting melt at a casting temperature sufficiently high that substantially no solid metal is present.

For the purposes of describing the preferred embodiments of the present invention, cast composite materials can be classified into two groups, those with chemically highly reactive particles and those with chemically nonreactive particles. The principal obstacle with forming cast composite materials containing reactive particles is to prevent particle dissolution and unwanted formation of intermetallic compounds, while achieving wetting. The commercially most important reactive particle is silicon carbide. The principal problem with forming cast composite materials containing nonreactive particles is achieving some degree of reactivity and wetting. The commercially most important nonreactive particle is aluminum oxide. In each case, sufficient fluidity must be exhibited by the melt for casting.

According to one preferred embodiment of the invention for dealing with reactive particles, a process for preparing a cast composite material having particles embedded in an aluminum-alloy matrix having more than about 7 weight percent silicon comprises the steps of providing a molten mixture of the particles, and an aluminum-based wetting alloy having no more than about 7 weight percent silicon; mixing together the molten mixture under conditions such that the aluminum wetting alloy is wetted to the particles; making an addition of silicon and other elements as needed to adjust the silicon content of the melt to its desired final composition which has more than about 7 weight percent silicon, and dissolving and distributing the addition throughout the melt; and casting the resulting melt.

A particularly useful cast composite material has reactive silicon carbide particles embedded in an aluminum-alloy matrix with about 10 weight percent silicon. Castings of this alloy can be made only with great difficulty using the approach of combining all of the ingredients together and mixing. Although the alloy can be mixed, the particulate matter enters the melt slowly, and the melt becomes so viscous that it is difficult to cast.

To prepare such an alloy by the preferred approach, as shown in FIG. 1 a wetting alloy of aluminum plus about 7 weight percent silicon is prepared and mixed with silicon carbide particles using the approach discussed in U.S. Pat. Nos. 4,759,995 and 4,786,467, whose disclosures are incorporated by reference. Wetting of the wetting alloy to the particles is readily accomplished in about 1 hour of mixing, and the viscosity is acceptable. An addition of the remaining silicon and any other alloying additions required to adjust the matrix to the required alloy content is then made, those additions are dissolved and distributed throughout the volume of the melt, and the melt is cast.

The improvement achieved by the present process is quite surprising. Normally, the fluidity of aluminum-silicon alloys increases with increasing silicon content. Achieving better wetting with a lower silicon content alloy is not expected.

The following examples are intended to illustrate the preferred approach for the preparation of cast composite materials containing reactive particles, but should not be taken as limiting of the invention.

EXAMPLE 1

To prepare a cast composite material of 20 volume percent of silicon carbide particles in a matrix alloy of 10 weight percent silicon, 1 weight percent magnesium, balance aluminum, a wetting alloy of 7 weight percent silicon, 1 weight percent magnesium, balance aluminum was prepared. The appropriate amounts of silicon carbide and the wetting alloy were mixed according to the procedures disclosed in the '995 and the '467 patents. More specifically, the wetting alloy was melted at 1240° F., and the appropriate amount of silicon carbide particles was added to the surface of the melt under vacuum over a period of 35 minutes, while the melt was mixed with an impeller. After all the silicon carbide was added, mixing was continued for another 25 minutes under vacuum. This procedure produced full wetting of the aluminum-7 weight percent silicon, 1 weight percent magnesium alloy to the particles. The mixing was stopped, the chamber vented to air, and a sufficient amount of silicon was added to adjust the matrix composition to 10 weight percent silicon and 1 weight percent magnesium. The chamber was sealed and a vacuum drawn, and mixing was continued for another 15 minutes to dissolve the alloying additions and distribute them throughout the melt. The composite material was cast into pigs. The pigs were provided to a foundry for remelt, and the remelted composite material was observed to have excellent fluidity for casting into narrow mold passages.

EXAMPLE 2

Example 1 was repeated, except that stepped alloying was not used. That is, the conventional practice was followed wherein the final matrix alloy of 10 weight percent silicon, 1 weight percent magnesium, balance aluminum was prepared. Silicon carbide particulate in the appropriate amount was added to the melt, and the melt and particles mixed together for the same amount of time as in Example 1. The resulting melt was very viscous and could not be cast into small-diameter passages in molds.

EXAMPLE 3

Example 1 was repeated, except that the composite was made to contain 10 volume percent of silicon carbide particles. The final melt was fluid and could be cast into molds with both large and small passageways.

EXAMPLE 4

Example 2 was repeated, except that the composite was made to contain 10 volume percent of silicon carbide particles.

EXAMPLE 5

The mechanical properties of cast specimens of the stepped-alloy addition cast composite material of Example 3 and the conventionally prepared cast composite material of Example 4 were tested. The following table reports the results in ksi, thousands of pounds per square inch.

TABLE I

| Process | Yield Strength (ksi) | Tensile Strength (ksi) |
|---|---|---|
| Prior | 42 | 47 |
| Stepped | 49 | 56 |

The composite materials produced with the stepped addition of alloying ingredients exhibit significantly improved post-casting properties as compared with those produced by the conventional approach.

The second class of particles is nonreactive particles such as aluminum oxide particles. According to another preferred embodiment of the invention for dealing with nonreactive particles, a process for preparing a cast composite material having particles embedded in an aluminum-alloy matrix comprises the steps of providing a molten mixture of the particles, and an aluminum-based wetting alloy having about 1 weight percent silicon and about 0.6 weight percent magnesium; mixing together the molten mixture under conditions such that aluminum wetting alloy is wetted to the particles; making an addition of elements as needed to adjust the alloy content of the melt to its desired final composition, and dissolving and distributing the addition throughout the melt; and casting the resulting melt.

To prepare a cast composite material containing nonreactive particles, the particles are first mixed with a wetting alloy which is known to wet the particles and also has sufficient fluidity for mixing. For example, it is known that aluminum alloys containing about 1 weight percent silicon and 0.6 weight percent magnesium readily wet aluminum oxide particles during mixing. Many aluminum matrix alloys of interest contain at least 1 weight percent silicon and at least 0.6 weight percent magnesium, so initial wetting can be accomplished with an aluminum alloy of that composition. After wetting, the composition of the matrix is adjusted with further additions of alloying elements. The initial wetting is accomplished using the wetting alloy and the procedure and the '995 and '467 patents.

The following example is intended to illustrate aspects of the invention as related to wetting of nonreactive particles, and should not be taken as limiting the invention in any respect.

EXAMPLE 6

A cast composite material was prepared of 10 volume percent aluminum oxide particles in an aluminum alloy containing 10 weight percent silicon, 0.6 weight percent magnesium, 0.7 weight percent iron, and 0.4 weight percent manganese. This cast composite material is exceedingly difficult to prepare by conventional methods, because the particles wet only slowly. The molten composite material is so viscous that it is nearly impossible to cast into a mold. To prepare the cast composite material using the approach of the invention, a matrix alloy of 1 weight percent silicon, 0.6 weight percent magnesium, 0.7 weight percent iron, and 0.4 weight percent manganese, balance aluminum, was melted in a crucible at 1245° F. under vacuum, and the appropriate amount of aluminum oxide particles added over a period of 20 minutes. The aluminum-based matrix alloy contains 1 weight percent silicon and 0.6 weight percent magnesium, a composition known to achieve wetting to aluminum oxide particles. After all of the particulate matter was added, the melt was mixed under vacuum for another 20 minutes, following the approach of the '995 and '467 patents. This combination of matrix alloy composition and mixing conditions produced good wetting of the matrix alloy to the particles. Mixing was stopped, the chamber was vented to air, and sufficient silicon added to adjust the matrix content to 10 weight percent silicon (with the amounts of the other alloying additions essentially unchanged). The vacuum was reapplied, and mixing continued for another 15 minutes. The composite was then cast into foundry pigs. The cast composite material exhibited excellent fluidity, and was suitable for preparation of castings having narrow passageways.

In the preceding disclosure and examples, procedures for achieving acceptable wetted cast composite materials of both reactive and nonreactive particles have been demonstrated. In each case, composite materials that are difficult to make by the conventional approach are prepared using the conventional mixing procedure and a matrix alloy that is known to be operable to first achieve wetting of the matrix alloy to the particles, and thereafter adjusting the composition of the matrix to the preselected alloying level. In each case, no coatings on the particles, special alloying elements, special atmospheric additions, or overly elevated temperatures are required. The only changes to the processing procedures are to add some alloying elements after wetting is complete, and to extend the mixing for a short time to incorporate these later additions into the melt.

The present invention therefore provides a manufacturing technique for preparing cast composite materials that produces materials which are not commercially feasible by conventional processing. Although particular embodiments of the invention have been described in detail for purposes of illustration, various modifications may be made without departing from the spirit and scope of the invention. Accordingly, the invention is not to be limited except as by the appended claims.

What is claimed is:

1. A process for preparing a cast composite material having particles embedded in an aluminum-alloy matrix having more than about 7 weight percent silicon, comprising the steps of:

providing a molten mixture of the particles, and an aluminum-based wetting alloy having no more than about 7 weight percent silicon;

mixing together the molten mixture under conditions such that aluminum wetting alloy is wetted to the particles;

making an addition of silicon and other elements as needed to adjust the silicon content of the melt to its desired final composition which has more than about 7 weight percent silicon, and dissolving and distributing the addition throughout the melt, the step of making an addition to occur after the step of mixing together; and casting the resulting melt.

2. The process of claim 1, wherein the particles are silicon carbide.

3. The process of claim 1, wherein the particles are aluminum oxide.

4. The process of claim 1, wherein the wetting alloy has about 7 weight percent silicon.

5. The process of claim 1, wherein the wetting alloy has about 1 weight percent silicon and about 0.8 weight percent magnesium.

* * * * *